US006176097B1

(12) United States Patent
Kim

(10) Patent No.: US 6,176,097 B1
(45) Date of Patent: Jan. 23, 2001

(54) SIDE BY SIDE TYPE REFRIGERATOR AND METHOD FOR CONTROLLING TEMPERATURE IN VEGETABLE BOX THEREIN

(75) Inventor: Sang Bae Kim, Kyongsangnam-do (KR)

(73) Assignee: LG Electronics Inc., Seoul (KR)

( * ) Notice: Under 35 U.S.C. 154(b), the term of this patent shall be extended for 0 days.

(21) Appl. No.: 09/470,999

(22) Filed: Dec. 23, 1999

(30) Foreign Application Priority Data

Dec. 24, 1998 (KR) ..... 98/58004

(51) Int. Cl.[7] ..... F25D 17/04
(52) U.S. Cl. ..... 62/187; 62/180; 62/89
(58) Field of Search ..... 62/187, 180, 186, 62/229, 203, 208, 89

(56) References Cited

U.S. PATENT DOCUMENTS 4,834,169 * 5/1989 Tershak et al. ..... 62/187 X
5,477,699 * 12/1995 Guess et al. ..... 62/187
5,732,561 * 3/1998 Kim ..... 62/89
5,809,790 * 9/1998 Kwon ..... 62/187 X

* cited by examiner

*Primary Examiner*—Harry B. Tanner
(74) *Attorney, Agent, or Firm*—Fleshner & Kim, LLP

(57) ABSTRACT

Side by side type refrigerator and method for controlling a temperature in a vegetable box therein, the method including the steps of (1) sensing the temperature in the vegetable box in a lower portion of a refrigerating chamber, and comparing the temperature in the vegetable box to a preset temperature of the vegetable box, under a state operation of the refrigerator is stopped, and (2) opening a damper in an upper portion of the refrigerating chamber when the temperature in the vegetable box is higher than the preset temperature in the vegetable box as a result of the comparison, and closing the damper when the temperature in the vegetable box is lower than the preset temperature in the vegetable box as the result of the comparison, thereby supplying the cold air in the freezing chamber to the vegetable box in the refrigerating chamber by means of natural circulation when the damper is opened, whereby supplying appropriate cold air to the vegetable box without separate cold air duct.

2 Claims, 6 Drawing Sheets

SIDE BY SIDE TYPE REFRIGERATOR AND METHOD FOR CONTROLLING TEMPERATURE IN VEGETABLE BOX THEREIN

BACKGROUND OF THE INVENTION

1. Field of the Invention

The present invention relates to a side by side type refrigerator and a method for controlling a temperature in a vegetable box therein, and more particularly, to a side by side type refrigerator which can cool down a vegetable box to a preset temperature without separate cooling duct, and a method for controlling a temperature in a vegetable box therein.

2. Background of the Related Art

Refrigerators may be sorted as a conventional refrigerator which has a freezing chamber and a refrigerating chamber arranged in a vertical direction, and a side by side type refrigerator which has the freezing chamber and the refrigerating chamber arranged side by side. FIG. 1 illustrates a front view of a related art side by side type refrigerator with doors opened, and FIG. 2 illustrates a section of refrigerating chamber in the related art side by side type refrigerator, referring to which a structure of the related art side by side type refrigerator will be explained.

The side by side type refrigerator is provided with a barrier 30 stuffed with an insulating material for separating the freezing chamber 10 and the refrigerating chamber 20 in left and right sides. There is an evaporator 12 in rear of the freezing chamber 10 for cooling down air in the refrigerator, and there is a fan 14 over the evaporator for circulation of cooled air within the refrigerator. And, there is a damper assembly 24 having a damper 22 over the refrigerating chamber, and there is a vegetable box 28 under the refrigerating chamber for storage of vegetable and the like. There is a cold air passage 16 in an upper portion of the barrier 30 for supplying a cold air heat exchange in the evaporator 12 to the refrigerating chamber 10, and there is a return passage 18 in a lower portion of the barrier 30 for return of a cold air having circulated through the refrigerating chamber 20 and heated up to a relatively high temperature toward the evaporator 12, again. There is the damper 22 at an outlet of the cold air passage 16 for regulating cold air supply to the refrigerating chamber 20, to an outlet of which damper 22 a cold air discharge opening 25 for supplying the cold air to the refrigerating chamber 18 and a cold air duct 26 for supplying the cold air to the vegetable box 28 are connected. The unexplained numeral 29 denotes a temperature sensor for sensing a temperature in the refrigerating chamber 20.

A process for circulating cold air through a related art side by side type refrigerator will be explained with reference to FIGS. 1 and 2.

One portion of the cold air, heat exchanged in the evaporator 12 through which cold refrigerant circulates, is supplied to the freezing chamber 10 by the fan 14, and the other portion of the cold air is supplied toward the damper 22 in the refrigerating chamber 20 through the cold air passage 16. A portion of the cold air supplied toward the damper 22 in the refrigerating chamber 20 is discharged to the refrigerating chamber 20 through the cold air discharge opening 25, and, therefrom, flows down to a lower portion of the refrigerating chamber 20. And, the other portion of the cold air supplied toward the damper 22 is provided to the vegetable box 28 in a lower portion of the refrigerating chamber 20 through a cold air duct 26 for the vegetable box in a rear wall of the refrigerating chamber 20. The cold air supplied to the freezing chamber 10 and the refrigerating chamber 20 is heated to a relatively high temperature through heat exchange with the stored food, and the like. The cold air heated to a relatively high temperature in the refrigerating chamber 20 flows toward the evaporator 12 again through the return air passage 18 formed in a lower portion of the barrier 30. The cold air circulation in the refrigerator repeats the aforementioned process. Cold air circulation in a conventional refrigerator is almost same with the aforementioned cold air circulation in the side by side type refrigerator, except that positions of the cold air passages and the damper are different.

A method for controlling a temperature in the related art side by side type refrigerator will be explained with reference to FIGS. 1 and 3.

In order to determine the refrigerator of putting into operation, a freezing chamber temperature Tf, or a refrigerating chamber temperature Tc is compared to a preset temperature Ts (S10). If it is found as a result of the comparison that the freezing chamber temperature Tf, or the refrigerating chamber temperature Tc is higher than the preset temperature Ts, the refrigerator is put into operation for supplying cold air to the freezing chamber 10 and the refrigerating chamber 20 (S11). That is, the compressor (not shown) and the fan 14 are driven, to supply cold refrigerant to the evaporator 12, to cool down air around the evaporator 12 by heat exchange with the evaporator. The cold air is supplied to the freezing chamber 10 and the refrigerating chamber 20. In this instance, the damper 22 is left open for supplying the cold air to the refrigerating chamber 20 (S12). Provided the damper 22 is opened, a portion of the cold air is supplied to inside of the refrigerating chamber 20, and the other portion of the cold air is supplied to the vegetable box 28 through the cold air duct 26. In the meantime, as the temperature in the refrigerating chamber 20 will drop as the cold air supply to the refrigerating chamber 20 is kept on, it is required to prevent the refrigerating chamber from being subcooled. Therefore, the temperature sensor 29 in the refrigerating chamber senses the refrigerating chamber temperature and compares to the preset refrigerating chamber temperature Tcs (S13). If it is found as a result of the comparison that the refrigerating chamber temperature Tc is lower than the preset refrigerating chamber temperature Tcs, the damper 22 is closed to stop cold air supply to the refrigerating chamber (S14) as there is a possibility of subcooling of the refrigerating chamber, otherwise the damper 22 is left open. In order to prevent unnecessary operation of the refrigerator, the temperature sensor(not shown) in the freezing chamber 50 senses the freezing chamber temperature Tf, and compares to a preset freezing chamber temperature Tfs (S15). If it is found as a result of the comparison that the freezing chamber temperature Tf is lower than the preset freezing chamber temperature Tfs, the operation of the refrigerator is stopped, otherwise the operation of the refrigerator is kept on. (S16). The aforementioned control method is in general programmed in a microcomputer, so that the microcomputer controls the compressor, the fan, the damper, and the like, to keep the freezing chamber temperature at approx. −18° C., the refrigerating chamber temperature at approx. 3–4° C., and the vegetable box temperature at approx. 5° C.

However, the related art method for controlling a temperature in a side by side type refrigerator has the following problems.

First, the related art side by side refrigerator shows a case when the vegetable box is subcooled or cooled inadequately because, as has been explained, the damper 22 is closed even if the vegetable box 28 is not cooled down adequately if the refrigerating chamber temperature Tc is lower than the preset refrigerating chamber temperature Tcs, that causes the inadequate cooling. And, if the operation of the refrigerator is stopped and the damper in the refrigerating chamber 20 is closed as the freezing chamber temperature or the refrigerating chamber temperature meets the preset temperature, the cold air in the refrigerating chamber 10 naturally circulates to flow down to a lower portion of the refrigerating chamber, which causes subcooling of the vegetable box 28 provided in a lower portion of the refrigerating chamber 20. And, in the case of the side by side type refrigerator, the damper 22 in the refrigerating chamber is positioned at an upper most portion of the refrigerating chamber 20, from which the cold air duct 26 is lead to the vegetable box 28. Therefore, the cold air duct 26 is longer than the cold air duct in the conventional refrigerator, with a greater flow resistance, which causes the cold air flowing through the cold air duct 26 to be heated as the cold air flows. At the end, the heated cold air to the vegetable box 28 can not cool down the vegetable box 28, adequately.

Second, the related art structure causes deterioration of an insulating performance of the refrigerator and a production cost rise, because the cold air duct 26 to the vegetable box 28 is provided separately. Moreover, foaming into a space between an inner case and an outer case of the refrigerating chamber having the cold air duct 26 formed therein is required in view of a refrigerator fabrication process, that deteriorates a working efficiency on a production line and causes the cold air duct 26 to impede a smooth flow of the foam liquid to deteriorate the foaming. The formation of the cold air duct 26 in a rear wall of the refrigerating chamber reduces a thickness of the insulating layer in the rear wall of the refrigerating chamber.

SUMMARY OF THE INVENTION

Accordingly, the present invention is directed to a side by side type refrigerator and a method for controlling a temperature in a vegetable box therein that substantially obviates one or more of the problems due to limitations and disadvantages of the related art.

An object of the present invention is to provide a side by side type refrigerator and a method for controlling a temperature in a vegetable box therein, which can cool down a vegetable box to an appropriate temperature without employing a cold air duct for the vegetable box.

Another object of the present invention is to provide a side by side type refrigerator and a method for controlling a temperature in a vegetable box therein, which improve an insulating performance, and save a production cost.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method for controlling a temperature in a vegetable box in a side by side type refrigerator includes the steps of (1) sensing the temperature in the vegetable box in a lower portion of a refrigerating chamber, and comparing the temperature in the vegetable box to a preset temperature of the vegetable box, under a state operation of the refrigerator is stopped, and (2) opening a damper in an upper portion of the refrigerating chamber when the temperature in the vegetable box is higher than the preset temperature in the vegetable box as a result of the comparison, and closing the damper when the temperature in the vegetable box is lower than the preset temperature in the vegetable box as the result of the comparison, thereby supplying the cold air in the freezing chamber to the vegetable box in the refrigerating chamber by means of natural circulation when the damper is opened.

In another aspect of the present invention, there is provided a side by side type refrigerator having a barrier for dividing the refrigerator into a freezing chamber and a refrigerating chamber, a cold air passage and a return air passage formed in an upper portion and a lower portion of the barrier, a damper in an upper portion of the refrigerator, and the vegetable box in a lower portion of the refrigerator, including a temperature sensor for sensing a temperature in the vegetable box, thereby, when the refrigerator is not in operation, opening the damper when a vegetable box temperature sensed by the temperature sensor is higher than a preset vegetable box temperature, for supplying the cold air in the freezing chamber to the vegetable box by means of natural circulation, whereby supplying appropriate cold air to the vegetable box without separate cold air duct.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
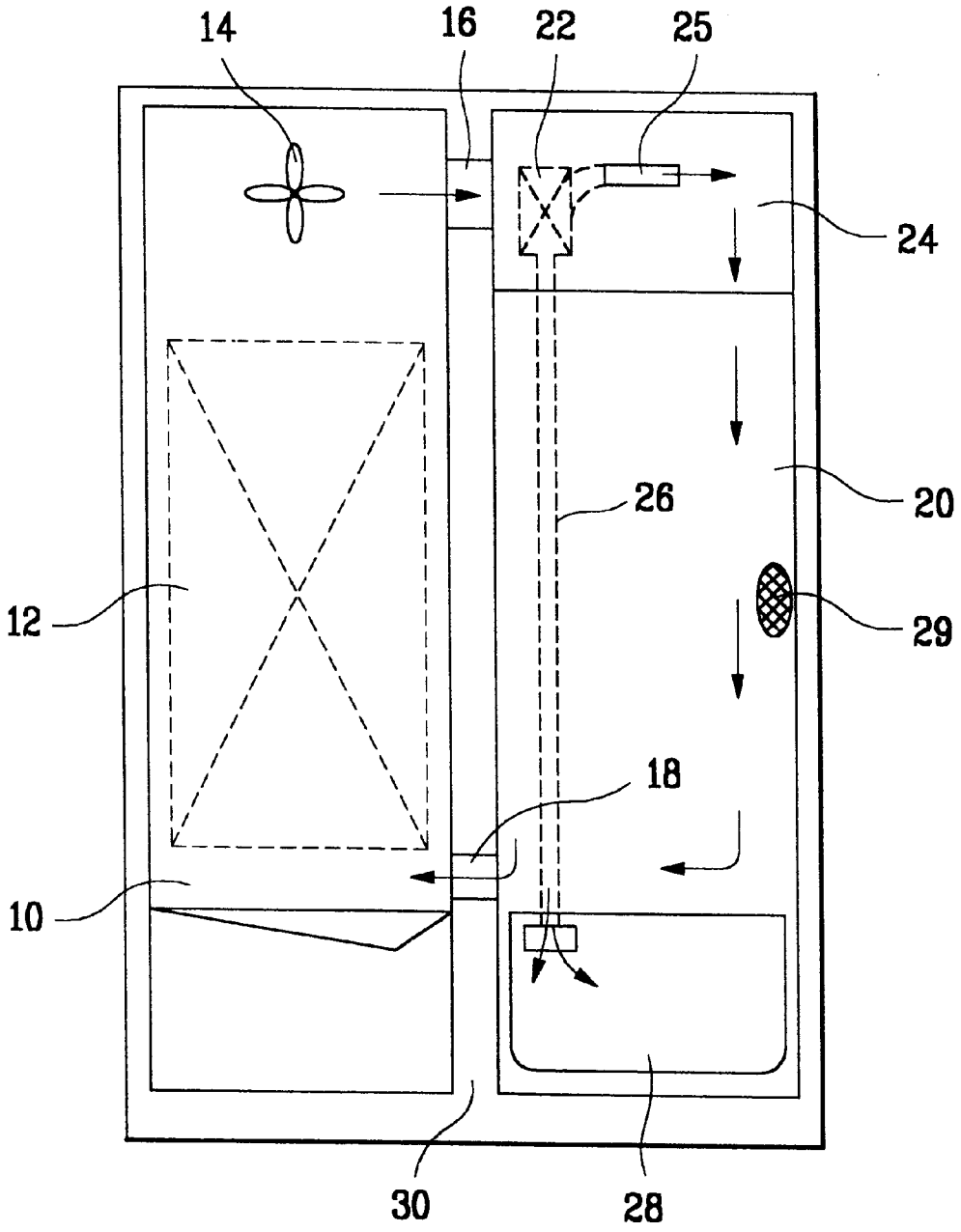
FIG.1 Related Art
FIG. 1 illustrates a front view of a related art side by side type refrigerator with doors opened.
Figure 2:
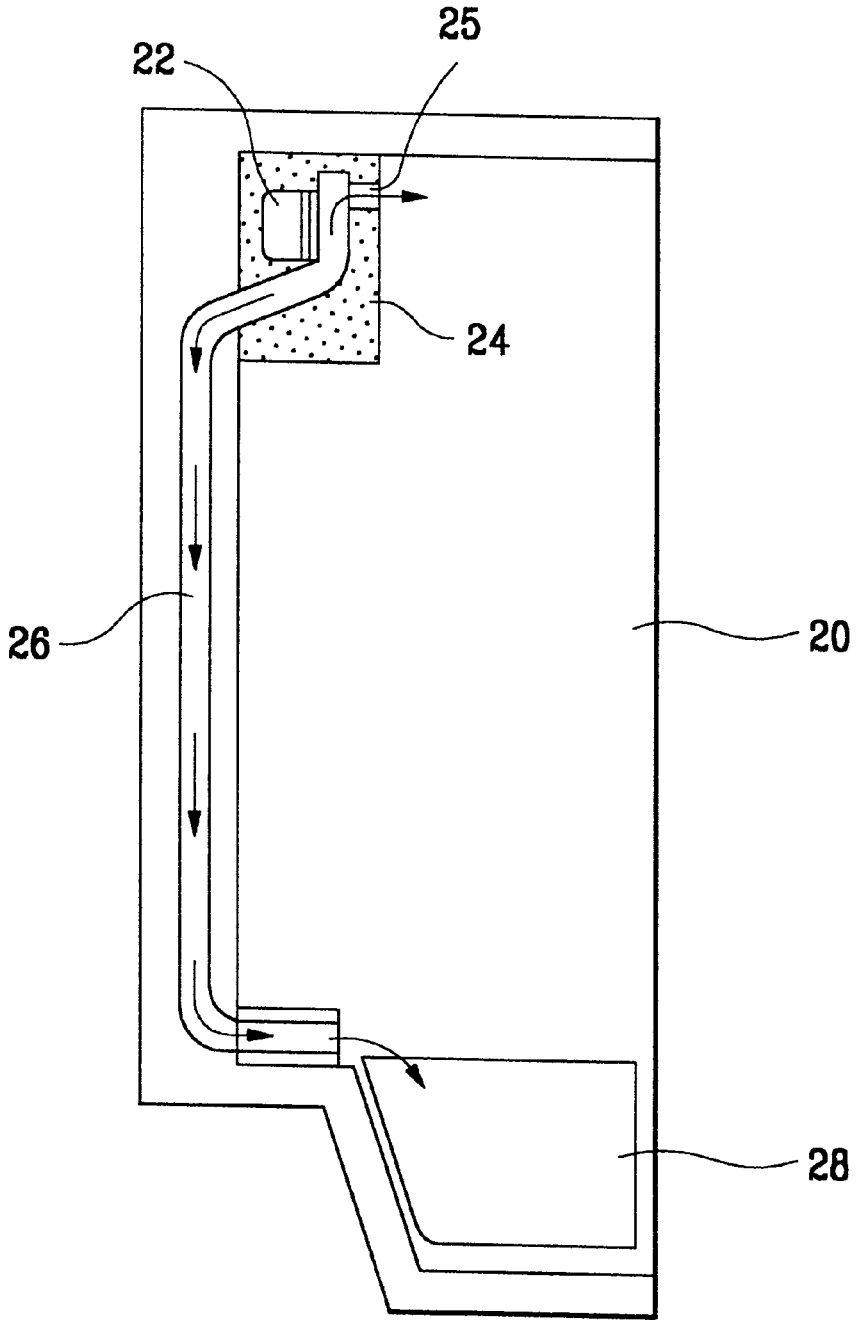
FIG. 2 Related Art
FIG. 2 illustrates a section of refrigerating chamber in the related art side by side type refrigerator.
Figure 3:
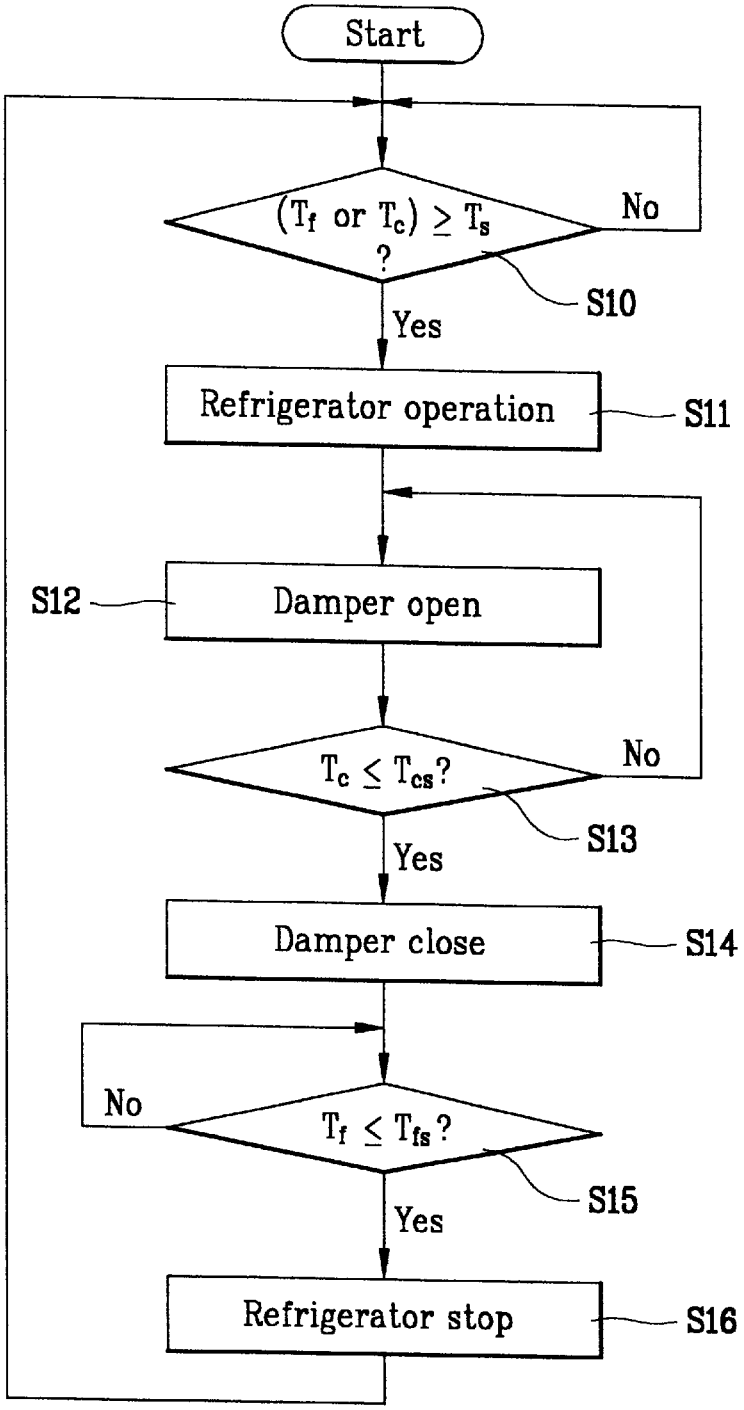
FIG.3 Related Art
FIG. 3 illustrates a flow chart showing a related art method for controlling a side by side refrigerator.
Figure 4:
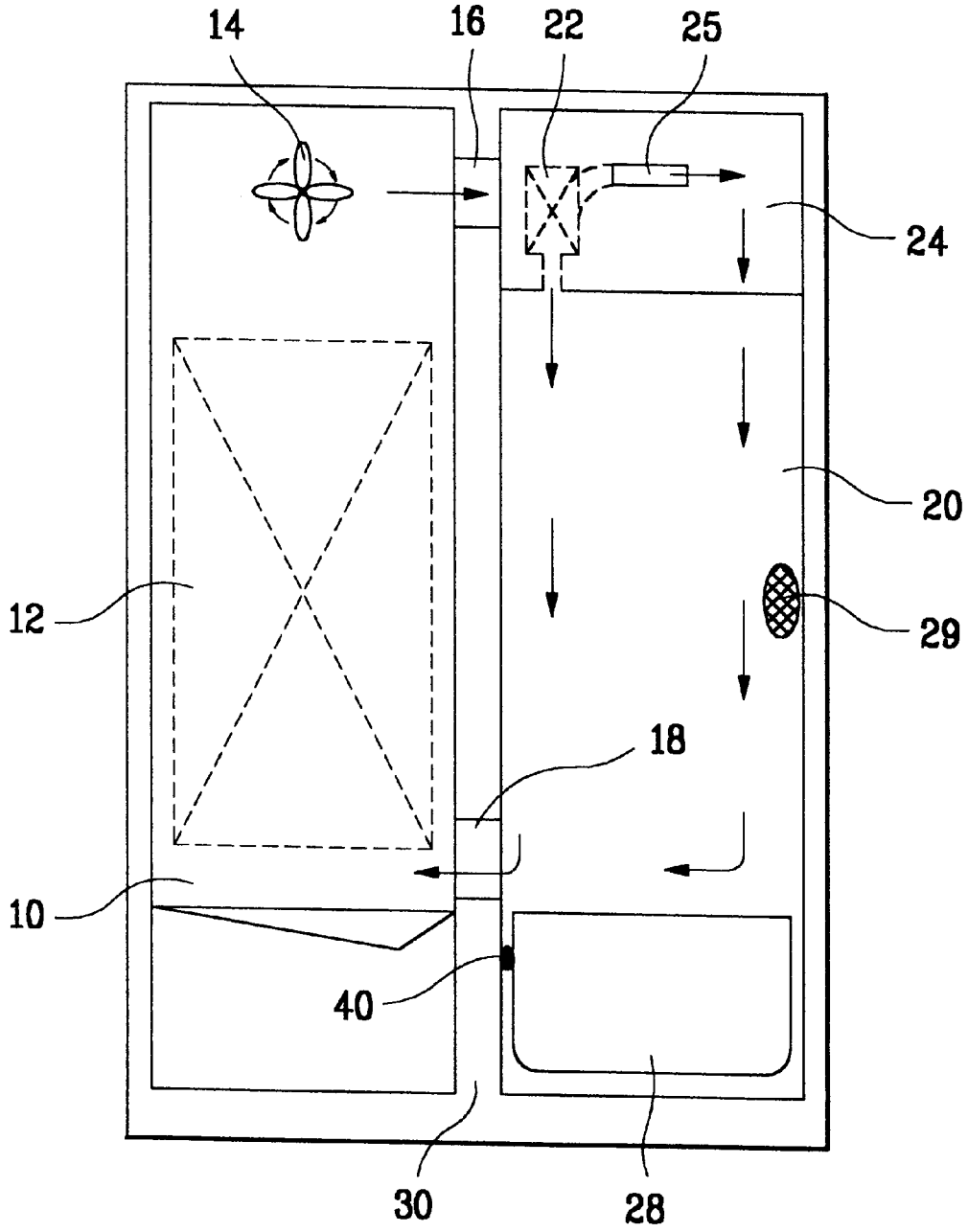
FIG. 4 illustrates a front view of a side by side type refrigerator in accordance with a preferred embodiment of the present invention, with a cold air circulation shown in a case of refrigerator operation.

Reference will now be made in detail to the preferred embodiments of the present invention, examples of which are illustrated in the accompanying drawings. Components of the present invention identical to the related art will be given the same reference numerals, and explanations on the same will be omitted. FIG. 4 illustrates a front view of a side by side type refrigerator in accordance with a preferred embodiment of the present invention, with a cold air circulation shown in a case of refrigerator operation, referring to which the side by side type refrigerator of the present invention will be explained. A basic structure of the side by side type refrigerator of the present invention is identical to the related art side by side type refrigerator, substantially, except that the side by side type refrigerator of the present invention can dispense with a vegetable box cold air duct which supplies cold air to the vegetable box 28 in the refrigerating chamber 20. And, a temperature sensor 30 is provided, additionally. Because the present invention suggests to supply the cold air in a freezing chamber 10 to the vegetable box 28 by means of natural circulation, no separate cold air duct is required. The temperature sensor 40 for sensing the vegetable box temperature is provided for determining supply of the cold air to the vegetable box 28 with reference to the vegetable box temperature sensed by the temperature sensor 40.

Figure 5:
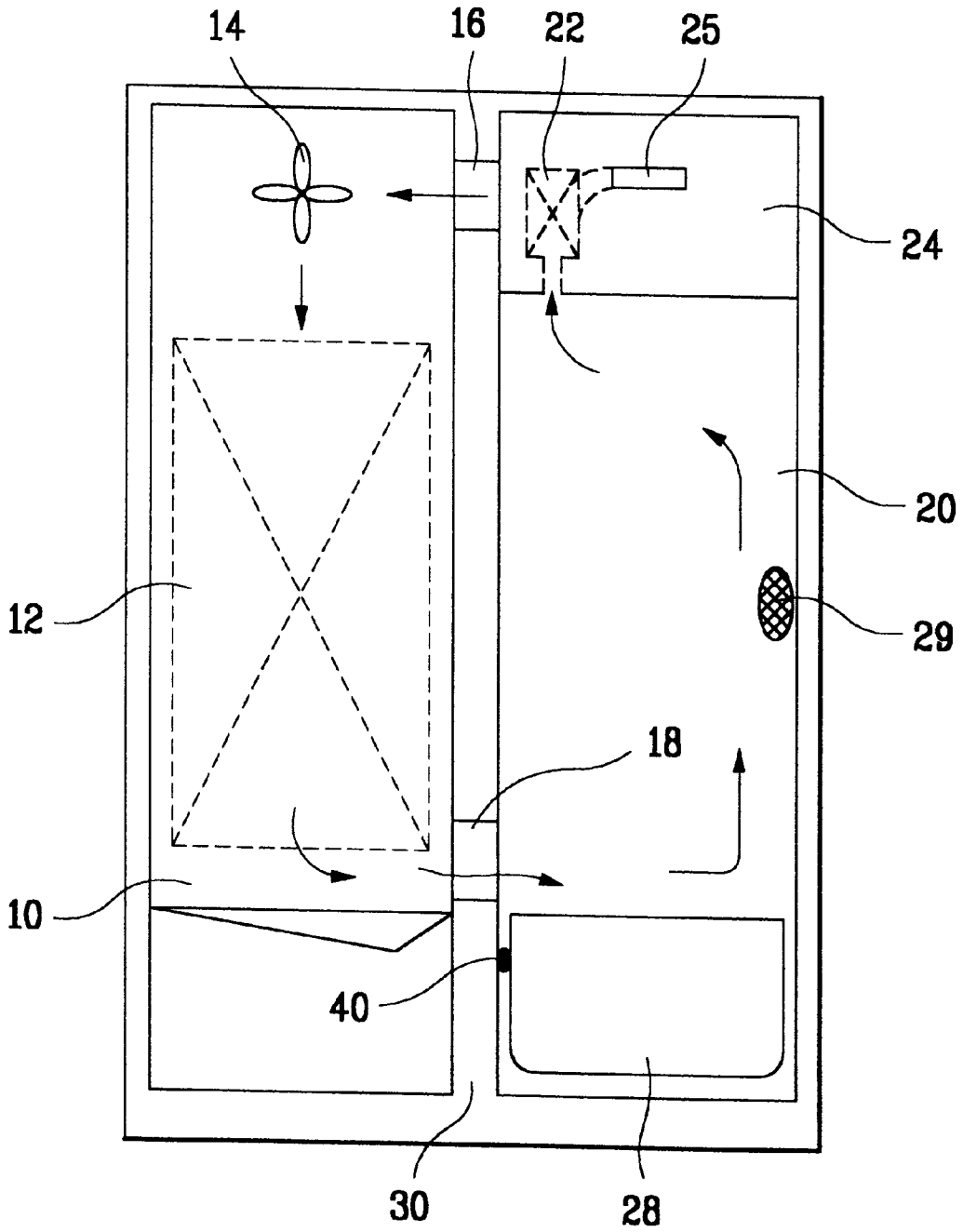
FIG. 5 illustrates a front view of a side by side type refrigerator in accordance with a preferred embodiment of the present invention, with a cold air circulation shown in a case the refrigerator is not in operation; and, FIG. 6 illustrates a flow chart showing a method for controlling a side by side refrigerator in accordance with a preferred embodiment of the present invention.
Figure 6:
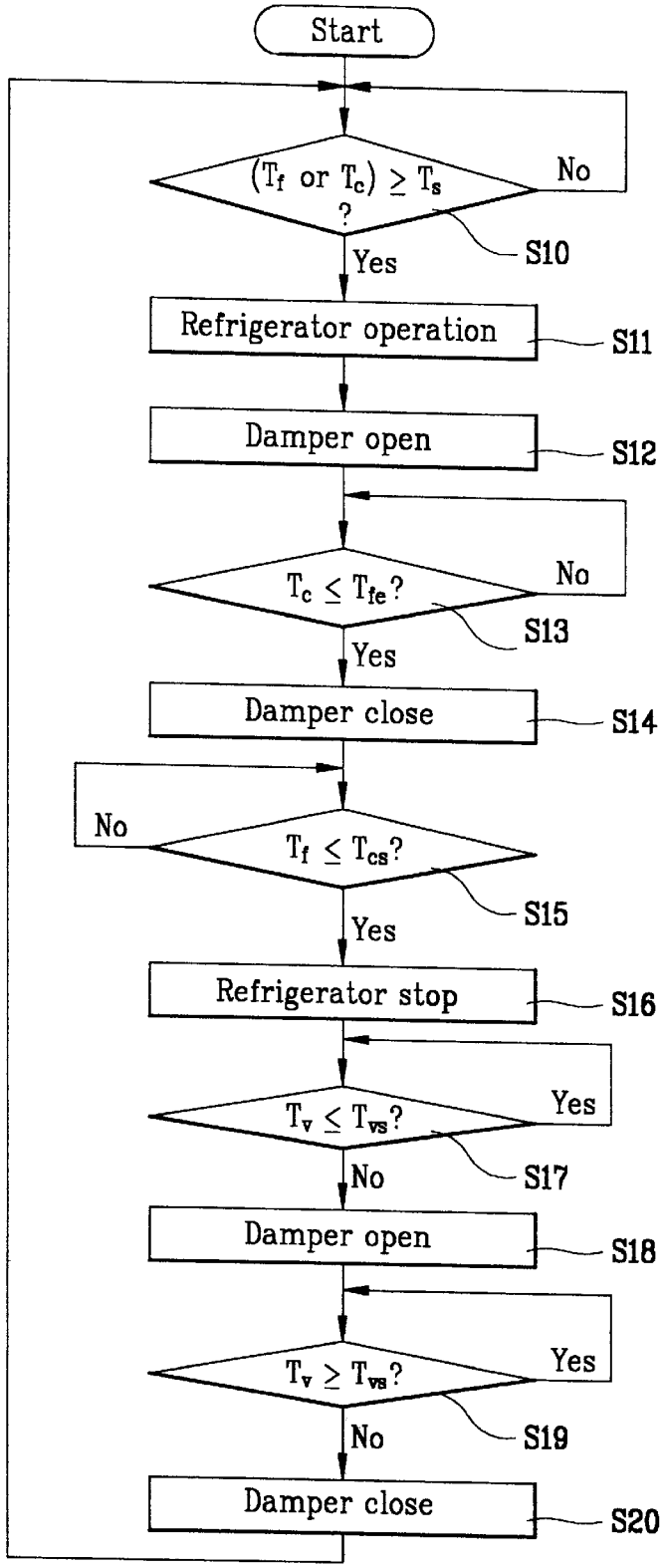

A method for controlling a vegetable box temperature in accordance with a preferred embodiment of the present invention will be explained in detail, with reference to FIGS. 4~6. The steps (S10~S16) from comparing a freezing chamber temperature Tf or a refrigerating chamber temperature Tc to a preset temperature to stopping operation of the refrigerator as a result of comparison of the freezing chamber temperature Tf to a preset freezing chamber temperature Tfs are the same with the related art, of which detailed explanation will be omitted. That is, referring to FIG. 4, a portion of the cold air heat exchanged in the evaporator 12 when the refrigerator is in operation is supplied to the freezing chamber 10, and the other portion is supplied to the refrigerating chamber 20 through a damper 22 in the refrigerating chamber 20 and a cold air discharge opening 25, to cool down the freezing chamber 10 and the refrigerating chamber 20 to required temperatures.

In the meantime, when the operation of the refrigerator is stopped as the freezing chamber temperature Tf drops lower than the preset freezing chamber temperature Tfs, the refrigerator is controlled in the following method for maintaining the preset temperature of the vegetable box. First, the vegetable box temperature Tv is sensed by the temperature sensor 40 in the vegetable box 28, and compared to the preset vegetable box temperature Tvs (S17). As a result of the comparison, if it is found that the vegetable box temperature Tv is higher than the preset vegetable box temperature, the damper 22 in the refrigerating chamber 20 is opened. A cold air circulation under this condition will be explained with reference to FIG. 5. When the operation of the refrigerator is stopped (S16), that is, when operation of the compressor and the fan 14 is stopped, the cold air in the freezing chamber 10 and the refrigerating chamber 20 is circulated, naturally; cold air of a relatively high temperature rises up and cold air of a relatively lower temperature goes down, causing pressures in upper portions of the freezing chamber 10 and the refrigerating chamber 20 lower than lower portions thereof. Upon opening the damper 22 in the upper portion of the refrigerating chamber 20(S18), the cold air of a relatively high temperature gathered in the upper portion of the refrigerator 20 flows into the freezing chamber 10 through the cold air passage 16 in the upper portion of the barrier 30. When the cold air flows into the freezing chamber 10, a pressure in the upper portion of the freezing chamber rises, to cause the cold air in the freezing chamber 10 to flow downwardly. Thus, when the cold air in the freezing chamber 10 flows downwardly, the cold air in the lower portion of the freezing chamber 10 flows toward the vegetable box 28 in the refrigerating chamber 20 through the return air passage 18. In conclusion, the present invention facilitates can cool the vegetable box 28 using the cold air gathered in the lower portion of the freezing chamber 10 under a state operation of the refrigerator is stopped without using a separate cold air duct for the vegetable box 28. If the vegetable box temperature Tv is lower then the preset vegetable box temperature Tvs, the damper 22 is closed (S19 and S20), when the compressor and the fan are stopped. Thereafter, operation of the refrigerator is determined depending on the refrigerating chamber temperature Tc or the freezing chamber temperature Tf. Of course, the driving of the compressor and the fan, and the open/closing of the damper dependent on the freezing chamber temperature Tf, the refrigerating chamber temperature Tc and the vegetable box temperature Tv are formulated into a series of algorithm, and programmed in a microcomputer, for automatic control.

The aforementioned side by side type refrigerator and method for controlling a temperature in a vegetable box therein have the following advantages.

First, the appropriate cooling of the vegetable box by means of natural circulation without a separate cold air duct facilitated by the present invention can prevent subcooling and inadequate cooling of the vegetable box, effectively. And, since the vegetable box is cooled down using the cold air gathered in the lower portion of the freezing chamber, an efficiency of the refrigerator can be improved.

Second, since the cold air duct for the vegetable box can be dispensed with, the different problems caused by the presence of the cold air duct inside of the inner case of the refrigerating chamber can be solved. That is, problems of the production cost rise caused by formation of the duct, deterioration of foaming workability, deterioration of foam performance, and a reduction of an insulating layer thickness of the refrigerating chamber can be solved, whereby reducing a refrigerator production cost and improving an insulating efficiency.

It will be apparent to those skilled in the art that various modifications and variations can be made in the side by side type refrigerator and the method for controlling a temperature in a vegetable box therein of the present invention without departing from the spirit or scope of the invention. Thus, it is intended that the present invention cover the modifications and variations of this invention provided they come within the scope of the appended claims and their equivalents.

What is claimed is:

1. A method for controlling a temperature in a vegetable box in a side by side type refrigerator, comprising the steps of:

(1) sensing the temperature in the vegetable box in a lower portion of a refrigerating chamber, and comparing the temperature in the vegetable box to a preset temperature of the vegetable box, under a state of operation of the refrigerator being stopped; and, (2) opening a damper in an upper portion of the refrigerating chamber when the temperature in the vegetable box is higher than the preset temperature in the vegetable box as a result of the comparison, and closing the damper when the temperature in the vegetable box is lower than the preset temperature in the vegetable box as the result of the comparison, thereby supplying the cold air in the freezing chamber to the vegetable box in the refrigerating chamber by means of natural circulation when the damper is opened.

2. A side by side type refrigerator having a barrier for dividing the refrigerator into a freezing chamber and a refrigerating chamber, a cold air passage and a return air passage formed in an upper portion and a lower portion of the barrier, a damper in an upper portion of the refrigerator, and the vegetable box in a lower portion of the refrigerator, comprising:

a temperature sensor for sensing a temperature in the vegetable box, thereby, when the refrigerator is not in operation, opening the damper when a vegetable box temperature sensed by the temperature sensor is higher than a preset vegetable box temperature, for supplying the cold air in the freezing chamber to the vegetable box by means of natural circulation.

* * * * *